United States Patent [19]

Carter

[11] Patent Number: 4,526,626

[45] Date of Patent: Jul. 2, 1985

[54] ANTI-CORROSION TREATMENT PROCESS

[75] Inventor: John H. Carter, Bromley, England

[73] Assignee: United Kingdom Atomic Energy Authority, London, England

[21] Appl. No.: 529,988

[22] Filed: Sep. 7, 1983

[30] Foreign Application Priority Data

Sep. 8, 1982 [GB] United Kingdom ..... 8225610

[51] Int. Cl.[3] ..... C23F 7/04

[52] U.S. Cl. ..... 148/6.14 R; 376/305; 376/306; 427/380

[58] Field of Search ..... 148/6.14 R; 427/380; 376/305, 306

[56] References Cited

U.S. PATENT DOCUMENTS

Re. 30,796 11/1981 Lesinski ..... 148/6.14 R 3,699,052 10/1972 Petrey ..... 376/306

*Primary Examiner*—Sam Silverberg

*Attorney, Agent, or Firm*—William R. Hinds

[57] ABSTRACT

An anti-corrosion treatment process for protecting alloys containing chromium and cobalt and/or nickel against corrosion by superheated water, which consists of heating the alloy in contact with a solution containing EDTA and ferrous ions to within a temperature range that forms a thick, chromium oxide-rich glassy film over the surface of the alloy. Where the EDTA is present in the form of one of its disubstituted alkali salts, the solution is preferably heated to 200° C. to 210° C. under chemically reducing conditions. Further heating of the solution to 225°-250° C. improves the corrosion resistance of the film, by increasing its iron oxides content and converting at least part of its structure to microcrystalline. Films produced by the present process are found to have a very low nickel and cobalt content.

14 Claims, 2 Drawing Figures

ANTI-CORROSION TREATMENT PROCESS

Figure 1:
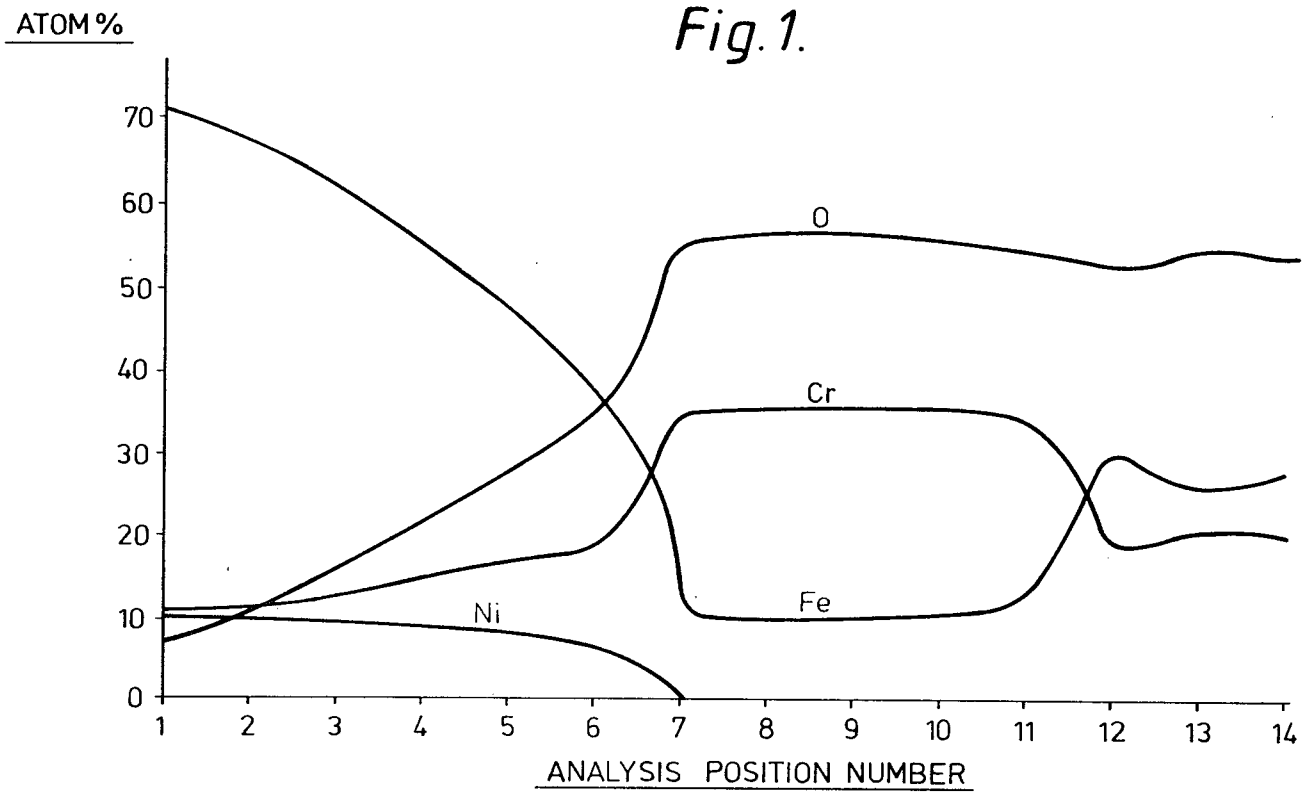

This invention relates to a process for the anti-corrosion treatment of metals that are susceptible to corrosive attack by superheated water (ie above 100° C.). In particular but not exclusively, the process is suitable for treating the primary coolant circuits of pressurized water-cooled nuclear reactor (PWR) plants.

The highly corrosive nature of the pressurized water which passes through in direct contact with the nuclear reactor core of a PWR plant requires the use of corrosion-resistant materials of construction to contain the water within the primary coolant circuit. Chromium-containing materials such as stainless steels, nickel-chromium alloys, and cobalt-chromium alloys form protective metal oxide films over their surfaces from their products of corrosion to resist further corrosion. The use of these materials adequately satisfies the requirement of corrosion resistance by limiting corrosion often to within a few microns of material thickness throughout the life of the plant. However, these materials can indirectly contribute an excessive build-up of radioactive contamination within the circuit, which presents a severe problem to the performance of maintenance work when the reactor is shut down because costly and time-consuming decontamination may be required before such work can be carried out.

The way in which these materials indirectly contaminate the circuit has been identified as follows. Products of corrosion are continuously released from the internal surfaces of the circuit under normal operating conditions, and are carried away by the circulating pressurized water into the reactor core. Certain of these products are converted into radioactive isotopes in the presence of the high neutron flux within the core, and are subsequently redistributed about the circuit back onto the surfaces of the oxide films. The development of a shutdown radiation field in the vicinity of the primary loop of a PWR is largely due to the formation of activated corrosion products containing $Co_{58}$ (from $Ni_{58}$) and $Co_{68}$ (from $Co_{59}$). Known methods of minimising these activities include careful control of coolant water pH to reduce corrosion product transport, as disclosed by Sweeton and Baes (J Chem. Thermodynamics 2 (1970) 479), by efficient filtration of the coolant water, and by modifications in primary loop design and materials of construction.

Methods of generally improving the corrosion resistance of materials exposed to high temperature water in boilers and the like are known whereby their surfaces are treated with chelating agents. In particular, a paper by T Kh Margulova et al (Thermal Engineering Vol 18 p 133–136) describes a two-stage process in which solutions of various sodium salts of ethylenediamine-tetra-acetic acid (hereinafter referred to as EDTA) were used to build up corrosion-resistant magnetite films on samples of pearlitic steels.

The first stage comprised heating the EDTA solution containing the samples of 150° C. Under these conditions, the samples were found to be corrosively attacked by each of the EDTA salt solutions in turn to form ferrous and/or ferric EDTA complex ions in solution. The second stage comprised raising the temperature of the solution to 290°–310° C., at which point virtually complete dissociation of the complexes occurred, depositing the dissolved metal as magnetite films onto the surfaces of the samples.

One disadvantage of this process is that it appears unsuitable for use on chromium containing alloys. This was borne out by later work that examined similar EDTA treatments on these metals. Efimov et al (Thermal Engineering Vol 24 p 15–19), found that no visible oxide films formed on two specimens of stainless steel horizontally mounted one above the other and exposed to a small volume of a disubstituted EDTA solution between them for up to 20 hours. The upper specimen was maintained at 190° C. and the lower at 290° C., indicating an average solution temperature of the order of 250° C. Sapieszko and Matijevic (Corrosion, Vol 37 p 152–160) reported that when exposed to a solution of hydroxy-ethylene-diamine triacetate (HEDTA) and hydrazine at 250° C. for 4 hours, a sample of Inconel 600 (a nickel-chromium alloy) was extensively corroded without forming an oxide film, and that on a sample of AISI Type 304 Stainless Steel, layers of nonadherent magnetite formed which exfoliated, exposing the base metal to further corrosive attack.

One object of the present invention is to provide an anti-corrosion treatment process using chelating agents whereby the above disadvantage is at least partly overcome.

According to the present invention there is provided an anti-corrosion treatment process for protecting an alloy, containing chromium and at least one metal selected from nickel and cobalt, against corrosion by superheated water comprising exposing the alloy to an aqueous solution containing iron, preferably ferrous, ions and a complexone selected from at least one of EDTA, a salt of EDTA, a derivative of EDTA (as hereinafter defined) and a salt of the derivative, and heating the solution to such a temperature range that a corrosion resistant film, that contains chromium oxide and iron oxide but that is substantially free from cobalt, nickel and compounds of cobalt and nickel, is formed on the surface of the alloy, and maintaining the solution within that temperature range until the corrosion resistant film is at least 300 nm thick.

In many cases, the alloy to be treated will also contain iron.

The present invention may be exploited to particular advantage in the treatment of the internal surfaces of PWR primary coolant circuits. The materials of construction used in these circuits (typically stainless steels, nickel-chromium alloys and cobalt-chromium alloys) usually of necessity contain chromium and at least one of cobalt and nickel. Appreciable amounts of iron are also usually present in at least some of the alloy component of the circuits. The present process may be used to pretreat the circuit during the pre-commissioning or commissioning phase of the PWR plant, or may be used an an intermittent treatment during the life of the plant, especially just before, during, or just after reactor shutdown periods for routine maintenance etc. Films formed on typical circuit alloys in accordance with the present invention are depleted in nickel and cobalt components with respect to their concentrations in the alloys themselves and therefore the emission of these metals from the treated alloy surface are significantly reduced in comparison to untreated alloy surfaces when both treated and untreated surfaces are subjected to prolonged exposure to superheated water. This reduction in cobalt and/or nickel release rate will in turn result in reduced levels of radioactive contamination in PWR primary coolant circuits.

Furthermore, because the present invention provides a means of reducing circuit contamination, any previous limitation on circuit design or choice of materials known to affect the emission of cobalt and nickel corrosion product release rate may be removed, and thereby overall PWR plant construction and operating cost may be reduced. For example, the specified use of special low cobalt alloys may no longer be necessary.

In this specification, a derivative of EDTA is any polyaminocarboxylic acid containing the group $—N(CH_2COOH)_2$ that forms a complex with ferrous, nickel and cobalt ions. One useful example is hydroxy ethylene diamine triacetate (HEDTA) or a salt thereof. Preferably, however, the alloy-treating solution contains a dialkali metal salt of EDTA itself, most preferably a dilithium or a disodium salt of EDTA. Such disubstituted salts of EDTA are preferred because they are found to form particularly stable, soluble complex ions with nickel, cobalt and iron, and because the complexes that ferrous ions form with these disubstituted salts of EDTA are more stable than those which form with the un-, mono-, tri- and tetra-substituted counterparts of these salts. The presence, in the alloy treatment solution, of a highly stable complex between ferrous ions and the complexone appears to encourage thick film formation by preventing an excessive buildup of iron oxides in the film during the treatment process.

Furthermore, disubstituted salts of EDTA are found to be sufficiently acidic in solution to bring about a high rate of corrosion of the alloy surface necessary for thick film formation, whereas tri and tetra substituted salt are both alkali in aqueous solution which would result in much lower rates of corrosion. EDTA itself is also one of the most readily available and least expensive of the complexones.

The source of ferrous ions that are essential for the performance of the present process may be from within the alloy itself, from metal ions dissolved in the solution prior to contact with the alloy to be treated (introduced, for example, by using a ferrous salt EDTA or a derivative thereof), or from an adjacent iron-containing material also exposed to the same solution at the same time which may therefore release ferrous ions into solution. The solution is preferably maintained under reducing conditions during the treatment process, for example by adding small amounts of hydrazine, to encourage the formation of ferrous ions. The formation of ferric ions in solution appears to interfere with the formation of the film, at least partly because they are much less soluble than ferrous ions and tend to deposit as ferric oxide on the alloy and thus inhibit the corrosive attack of the alloy surface by the solution necessary for a thick film formation. Furthermore, it is desirable to form the film under reducing conditions because such a film is more likely to resist corrosion by superheated water which is itself normally maintained under reducing conditions by the addition of hydrazine or dissolved hydrogen.

Where a dialkali salt of EDTA is employed as the complexone in the solution, the solution is preferably heated to and maintained within a temperature range of 175° C. to 225° C., most preferably 200° C. to 210° C., to form a chromium oxide-rich film on the alloy surface. Below 175° C., most chromium alloys are found to be moderately resistant to corrosive attack by acidic EDTA disubstituted salt-containing solutions, and film formation is therefore only very slight. Cobalt-chromium alloys are found to be extensively corroded by the solution in the temperature range 175°–200° C. with little or no formation of a corrosion resistant film, and so treatment of these alloys must in general proceed at a temperature at or in excess of 200° C. The rate of film formation appears to increase with increasing temperature to a maximum of about 210° C. producing a film whose outer 300 nm of thickness contains chromium as its major metal constituent, but thereafter incresing amounts of iron appear in the film, and the film's rate of formation is steadily reduced to about 225° C., at which temperature it has become negligible. When a dialkali metal salt of EDTA is employed treatment within the preferred temperature range may last for periods of 70 hours or more to produce protective oxide films on the alloys which may typically be as thick as 8 microns through exposure times of only 10–20 hours are often found to be sufficient. In this case it is also preferred that the final pH of the EDTA solution (which gradually increases as the hydrogen ions associated with the acidic complexone salt are consumed by corrosive attack) is maintained below about 8.5–9.0, because otherwise undesirable solid granular deposits are found to appear on the surface of the film.

The protective films formed on alloys in accordance with preferred embodiment of the present invention are found to adhere strongly to the alloy substrate, and to comprise mainly oxides of chromium and iron in percentage concentrations which indicate a mixture of chromic oxide ($Cr_2O_3$) and magnetite ($Fe_3O_4$). These films generally contain no detectable trace of nickel or cobalt within 300 nm of their outer surfaces. Conversion Electron Mossbauer Spectroscopy and glancing X-ray diffraction measurements on these films confirm that they are glassy and non-magnetic. A separate magnetite region if it existed in the film would be magnetic, which indicates that these films may be solid solutions of magnetite in chromic oxide, although the invention is not limited in any way by this explanation.

A film formed by the treatment of an alloy in accordance with a preferred embodiment of the present invention within a temperature range of between 175°–225° C., may additionally be treated by further heating the solution in contact with the alloy to within a temperature range of 210°–250° C., preferably 225°–250° C., and maintaining the solution within that temperature range to cause iron and/or oxides thereof to deposit onto or incorporate into the film such that the outer 300 nm of film thickness contains iron as its major metal constituent. The effect of this secondary treatment is to further increase the resistance of the film to corrosive attack by superheated water, whilst at the same time still preventing the deposition onto or incorporation into the film of nickel and/or cobalt to a depth of at least 300 nm from the outer surface of the film. Indeed, it is found essential to subject to some form of further treatment those alloys which are to be exposed to the superheated water conditions found in PWR primary coolant circuits (typically 250° C. at pH 10.5 under chemically reducing conditions), because under these conditions the glassy films formed at 175°–210° C. in particular are dissolved over relatively short exposure times.

The secondary treatment may typically last for periods of 10 to 100 hours, provided the pH of the solution is not allowed to rise above about 8.5–9.0. Corrosion resistance of the film appears particularly enhanced when the solution is maintained at a temperature approaching 250° C. Above about 250° C., however traces of cobalt or nickel are found to appear at the surface of the film. Analysis of films subjected to this secondary treatment indicate that the films become microcrystalline after secondary treatment and comprise mixed spinel oxides of ferrous chromite ($FeCr_2O_4$), and magnetite. Again, however, the invention is not limited by this explanation.

The mechanism by which deposition or incorporation of chromium and iron, rather than nickel and cobalt, occurs in the corrosion resistant film is probably associated with the thermal stability of the various metal ion complexes which form in the alloy treatment solution by corrosion of the surface of the treated alloy. At elevated temperatures, the thermal stability of cobalt and nickel ion complexes are presumed to be higher than the ferrous and chromium ion complexes, thus low solubility oxides of the latter metals will form at a lower temperature than those of the former as products of metal/complexone thermal decomposition or dissociation. This is supported by evidence which showed that when a metal containing the elements cobalt, nickel, iron and chromium was exposed to an EDTA solution according to the present invention, the solution concentration of complexed chromic ions fell above 175° C. and of complexed ferrous ions fell above about 200° C., whereas the solution concentration of complexed nickel and cobalt ions continued to rise to at least 230°–250° C. It is therefore evident that a similar preferential deposition or incorporation effect will occur if the solution itself provides an additional source of chromic and/or ferrous metal ions, for example by employing, in part at least, a mixture of a ferrous and/or achromium EDTA salt in the solution.

One possible explanation of the mechanism by which deposition in accordance with the present invention occurs, is that the glassy film exhibits porous or ion exchange characteristics during its formation, which allows the corrosion of the alloy surface by the solution to proceed at a faster rate that the dissolution of the chromium in the film into complexed chromium-EDTA ions in solution, and which thus encourages a thick film to build up. When the solution is heated to beyond 210° C., the ferrous EDTA complex ions in solution dissociate at an increasing rate, which increases the rate of iron deposition in the film. This slows the rate of film formation by reducing the film's porosity or ion exchange capability and thus protects the alloy surface against further corrosive attack. The buildup of iron in the film at these elevated temperatures in excess of 210° C. eventually imparts a virtually impervious microcrystalline structure to at least part of the film.

Figure 2:
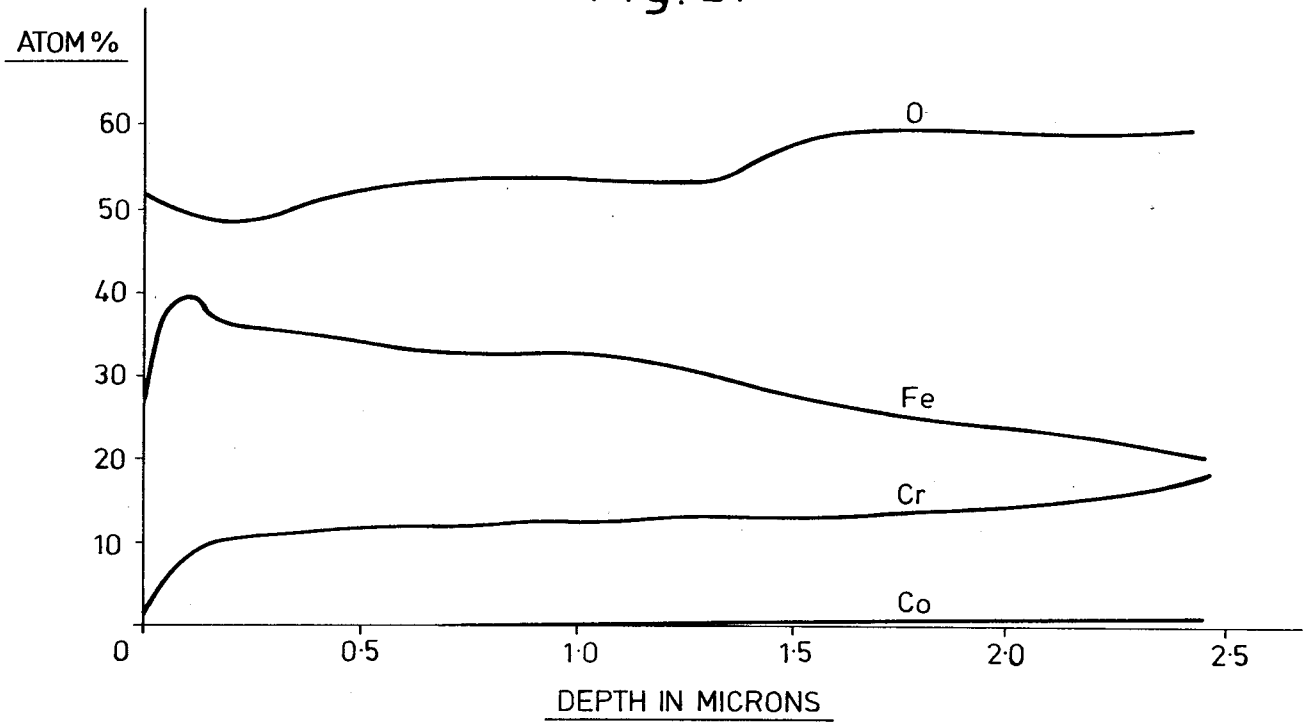

Methods of performing the present invention will now be described by way of Example only with reference to the accompanying drawings, in which FIG. 1 is a graphical illustration of the relationship between the atom % content of elements present at various positions through a corrosion resistant film formed on AISI 304 stainless steel in accordance with the method of Example 6, and FIG. 2 is a similar graphical illustration to that of FIG. 1 for a corrosion resistant film formed on Stellite 6 in accordance with the method of Example 8.

In the Examples, specimen coupons of materials were treated under laboratory conditions. In each Example, a solution was prepared by adding deaerated, demineralized water to a commercially available chelating agent of reagent grade. The solution was then poured into a one liter autoclave. At least one specimen coupon of a material to be treated was polished on one side, degreased with acetone, and washed with demineralized water. The coupon was then mounted in a stainless steel carrier and immersed in the solution within the autoclave. To ensure chemically reducing conditions exist within the solution throughout the treatment process, an appropriate volume of hydrazine was added to the solution, and once the autoclave head was fixed into place, the air space between the surface of the solution and head was purged with nitrogen. The material of the autoclave in contact with the solution during the process was AISI 316 stainless steel, which in addition to those metals present in the coupon provided a potential source of iron, nickel, chromium and cobalt which very approximately simulated their expected presence of a full scale treatment of a PWR primary coolant circuit. In no Example was the final pH of the solution allowed to exceed 8.5 to 9.0.

After completion of each treatment process, the coupon was removed for the autoclave, washed with demineralized water and acetone, and dried. The protective film which formed on the polished surface of the coupon was observed under the microscope and analysed to determine its thickness and composition.

Film thickness was determined by cutting and polishing a section through the coupon normal to the polished surface, or by using the Ball Cratering technique of Walls et al (Surface and Interface Analysis 1 (1979) 204) in which a typically 3 cm diameter ball bearing coated with grinding paste is caused to rotate against the surface to produce a crater which is a segment of a sphere. In either case the profile revealed was examined either by visible microscopy or by Scanning Electron Microscopy (SEM).

Film composition was determined by X-ray Photoelectron Spectroscopy (XPS) or by Auger Spectroscopy (AS) of the film surface. In XPS the film surface was eroded at a known rate by a calibrated argon ion bombardment technique to expose new film surfaces and known depths from the original surfaces, thus enabling further determinations of film compositions to be made at these depths. The conversion from ion bombardment dose measured (in A.s) to an approximate depth had been made by the empirical relation 1 micron=0.222 A.s. Using XPS coupled with argon ion bombardment, film compositions could be determined to a depth of about 2500 nm (2.5 microns). AS was employed on specimens which had been profiled by ball cratering. It uses an electron beam rather than an X-ray beam and is capable of much higher resolution than XPS, thus it is able to take many readings across a profile whereas XPS would average them.

EXAMPLE 1

Three coupons of AISI Type 304 stainless steel containing by weight 19.4% chromium, 8.7% nickel, 1.4% manganese, 0.29% cobalt, 0.04% copper, 0.016% silicon 0.07% carbon and the remainder iron, were prepared for treatment with a one-twentieth molar dilithium substituted EDTA salt solution containing 5 ppm hydrazine. The solution in the autoclave containing the coupons was first heated to a constant 150° for 65 hours, and a first coupon was then removed from the autoclave. The solution was then heated to a constant 175° C. for a further 65 hours, after which a second coupon was removed, and finally the solution was heated to a constant 200°–210° C. for a final 65 hours period before removing the remaining third coupon.

On examination, the surface of first coupon appeared bright and shiny, and SEM analysis revealed a protective film thickness of only 0.01 microns, indicating very little metal oxide formation. The surfaces of the second and third coupons were found to have a smooth, green, glassy appearance under the microscope. SEM analysis of the third coupon revealed a protective film 6 microns thick on average had formed over its polished surface. XPS analysis of the outer 500 nm of the film determined that the film was of a fairly uniform composition to this depth at least, comprising typically by weight 58.8% chromium, 11.3% iron, and 30.0% oxygen, with no detectable nickel or cobalt. Both the chromium and the iron present in the film were identified as being present in oxidized states, and the amount of oxygen in the film almost exactly stoicimetrically accounted for these oxidized states as being chromic oxide $Cr_2O_3$ and magnetite $Fe_3O_4$ respectively.

EXAMPLE 2

A fourth coupon of AISI Type 304 stainless steel was treated in an identical manner to that of the first, second and third coupons in Example 1, except that in addition the solution containing the fourth coupon was further heated from 200°-210° C. to a constant 225°-230° C. for 65 hours.

The surface of the oxide film formed on the fourth coupon had a matt black microcrystalline appearance as observed under the microscope. Microscopic examination of the cross section through the coupon revealed that the surface of the green glassy oxide had been converted to black crystalline material with uneven penetration. The surface layer extended to a depth of at least 300 nm as determined by the calibrated argon ion bombardment erosion technique, and had a typical composition by weight as determined by XPS analysis of 17.1% chromium, 54.2% iron, 24.1% oxygen and 1.7% molybdenum, with no detectable trace of nickel or cobalt. The presence of molybdenum in the surface layer can be explained as a constituent of the 316 stainless steel in the autoclave. The surface layer was obviously of a more complex structure than that of the underlying oxide film, because its oxygen content did not correspond to a simple mixture of chromic oxide and magnetitie, and some of the iron was detected as being in a metallic as opposed to an oxidized state. However, it can reasonably be assumed that from the analysis data, that the surface layer comprised mainly a mixed iron-chromium oxide with a spinel structure, similar to magnetitie.

EXAMPLE 3

A first coupon of Inconel 600, a nickel alloy containing by weight 15.8% chromium, 74.03% nickel, 0.37% manganese, 0.11% cobalt, 0.09% copper, 0.30% silicon, 8.65% iron, 0.056% carbon, 0.004% sulphur, 0.11% phosphorus, and 0.24% titanium, was prepared for treatment with a one-twentieth molar di-sodium substituted EDTA salt solution containing 5 ppm hydrazine. The solution in the autoclave containing the coupon was heated to a constant 185° C. for 70 hours.

The surface of the protective film which formed on the coupon was found to be smooth, green and glassy under the microscope; and very similar in appearance to that found on the second and third coupons of Example 1. The average thickness of the film as determined by SEM was 8 microns. XPS analysis of the outer 500 nm of this film again revealed a fairly uniform composition throughout, typically by weight 15.7% iron (oxidized), 49.4% chromium (oxidized), 31.0% oxygen, 1.4% titanium, and 2.4% carbon, with no detectable trace of nickel or cobalt.

EXAMPLE 4

A second coupon of Inconel 600 was pretreated in an identical manner to that of the first coupon in Example 3, except that in addition the solution containing the second coupon was further heated from 185° C. to a constant 225°-230° C. for 65 hours.

The surface of the second coupon was observed to have a matt black, microcrystalline appearance under the microscope, very similar to that observed on the fourth coupon of stainless steel treated in Example 2. XPS analysis of the surface to a depth of 300 nm revealed no trace of nickel or cobalt.

EXAMPLE 5

A coupon of Stellite 3, a cobalt alloy containing 31.1% chromium, 13.8% tungsten, and 54.1% cobalt was prepared for treatment with one-twentieth molar di-sodium substituted EDTA salt solution containing 5 ppm hydrazine. The solution in the autoclave containing the coupon was heated to a constant 200°-210° C. for 65 hours.

The resulting film formed on the coupon had a dark green, glassy appearance under the microscope. Argon ion bombardment followed by XPS analysis revealed the film had an average composition of 12.2% iron, 56.7% chromium, 30.9% oxygen, and 0.3% carbon, with no detectable trace of nickel or cobalt, to a dept h of 300 nm from its surface.

EXAMPLE 6

A coupon of Stellite 6, a cobalt alloy containing 25.7% chromium, 57.3% cobalt, 5% tungsten and small amounts of iron, nickel etc and a coupon of AISI 304 stainless steel, were prepared for treatment with one-twentieth molar disodium substituted EDTA salt solution containing 5 ppm hydrazine. The solution in the autoclave containing the coupons was heated to a constant 205°-213° C. for 22 hours, then the temperature was raised to 227° C. over 8 hours and maintained at 227°-232° C. for a further 15 hours.

The prepared surfaces of these coupons after treatment were observed to have a matt black, micrcrystalline appearance under the microscope, very similar to that observed on the fourth coupon of stainless steel pretreated in Example 2, and on the second coupon of Inconel 600 pretreated in Example 4. XPS analysis of the surfaces of both coupons to a depth of 300 nm revealed no detectable trace of nickel or cobalt. Ball Cratering was carried out on both coupons; the stainless steel coupon had a film thickness of 0.7±0.1 microns, and the Stellite 6 coupon had a film thickness of 1.0±0.02 microns.

The profiles on both films thus exposed were examined by Auger Spectroscopy. The Stellite 6 coupon had a cobalt-free surface to a depth of approximately 300 nm, with increasing amount of cobalt detected towards the metal surface. The composition profile of the film formed on the fifth coupon of stainless steel is shown graphically in FIG. 1. FIG. 1 illustrates the atom % content of the principal elements present through the film at equally spaced Analysis Positions (AP's) across the profile of the film revealed by Ball Cratering, beginning at the metal surface proper (AP 1) and ending at the film outer surface (AP 14). The result of Auger analysis illustrated in FIG. 1 indicated that the surface at AP 1 to 6 consisted mainly of metal substrate with steadily increasing amounts of metal oxide present, with the film proper (thickness 0.7±0.1 microns) corresponding to AP 7 to 14 inclusive. The inner film region of almost constant composition between AP 7 and 10 appeared to be non-crystalline, whereas the outer film region between AP 12 and 14 was found to be crystalline. A glancing angle X-ray study gave a value of 8.375±0.01 Å for the unit cell parameter of the film surface on both coupons, which identified the crystalline material in the films as a ferrous chromite spinel.

The treated coupons of Stellite 6 and stainless steel were then exposed to a small circulating water loop simulating conditions found within a PWR primary coolant circuit. The water was maintained at 250° C. and pH 10.5 using LiOH, and was dosed with 5–10 ppm hydrazine. After 600 hours of exposure, both coupons showed small weight gains of 0.08 mg $cm^{-2}$ (Stellite) and 0.11 gm $cm^{-2}$ (stainless steel), indicating that little or no corrosion of either coupon had occurred.

EXAMPLE 7

Two coupons of Stellite 6 were prepared and treated in an identical manner to that of Example 6. They were made radioactive by neutron bombardment. After allowing short-lived activity to decay, the major radioactive component present in the treated coupons was found to be cobalt 60 which emitted characteristic gamma radiation. The two radioactive, treated coupons were exposed to a flow of simulated PWR primary circuit water (pH 10.5 280° C., dosed with hydrogen gas). During the initial two week exposure period the cobalt release from the specimens as measured by the cobalt 60 gamma activity was only one sixth that of an untreated but otherwise indentical Stellite 6 coupon which had also been made radioactive by neutron bombardment.

EXAMPLE 8

A coupon of Stellite 6 was prepared for treatment with one-twentieth molar disodium-substituted EDTA salt solution containing 5 ppm hydrazine. The solution in the autoclave containing the coupon was heated to a constant 205±5° C. for 22 hours, then the temperature was raised to 250° C. over 12 hours and maintained there for a further 60 hours.

The surface of this coupon had a similar appearance to those treated coupons of Examples 6 and 7. Ball Cratering gave a film thickness of 5.5±1.0 microns. XPS analysis was carried out to a depth of 2.4 microns from the outer surface of the film formed on the coupon, and the results of the analysis are illustrated graphically in FIG. 2, which plots the atom % content of the principal elements present in the film, against depth from the outer surface of the film. The film contained no nickel, and though a trace of cobalt appeared at a depth of 0.8 microns, it never exceeded 2 atom % of the film to a depth of at least 2.4 microns.

Unlike the film formed on the AISI 304 stainless steel coupon of Example 6, the film formed on the Stellite 6 coupon of Example 8 was very much thicker and did not have two clearly defined film regions, indicating that crystalline transformation of the film had taken place to a far greater depth into the film in the latter coupon. A glancing X-ray study gave a value of 8.393±0.005 Å for the unit cell parameter of the film near its outer surface, which identifies the crystalline material as having a mixed ferrous chromite-magnetite spinel structure.

I claim:

1. An anti-corrosion treatment process for protecting an alloy, containing chromium and at least one metal selected from nickel and cobalt, against corrosion by superheated water comprising exposing the alloy to an aqueous solution containing iron, preferably ferrous, ions and a complexone selected from at least one of EDTA, a salt of EDTA, a derivative of EDTA and a salt of the derivative, and heating the solution to such a temperature range that a corrosion resistant film, that contains chromium oxide and iron oxide but that is substantially free from cobalt, nickel and compounds of cobalt and nickel, in formed on the surface of the alloy, and maintaining the the solution within that temperature range until the corrosion resistant film is at least 300 nm thick.

2. A process according to claim 1 wherein the complexone comprises a disubstituted alkali metal salt of EDTA.

3. A process according to claim 1 wherein the solution also contains a reducing agent.

4. A process according to claim 3 wherein the reducing agent comprise hydrazine.

5. A process according to claim 2 wherein the solution is heated to within the temperature range 175° C. to 225° C., preferably 200° C. to 210° C.

6. A process according to claim 5 wherein the solution is subsequently heated to within the temperature range 210° C. to 250° C., preferably 225° C. to 250° C.

7. A process according to claim 1 wherein the complexone is selected from at least one of a ferrous salt of EDTA, a chromium salt of EDTA, a ferrous salt of a derivative of EDTA, and a chromium salt of a derivative of EDTA.

8. A method of treating the internal surfaces of a primary coolant circuit of a pressurised water reactor by an anti-corrosion treatment process for protecting an alloy, containing chromium and at least one metal selected from nickel and cobalt, against corrosion by superheated water comprising exposing the alloy to an aqueous solution containing iron, preferably ferrous, ions and a complexone selected from at least one of EDTA, a salt of EDTA, a derivative of EDTA and a salt of the derivative and heating the solution to such a temperature range that a corrosion resistant film, that contains chromium oxide and iron oxide but that is substantially free from cobalt, nickel and compounds of cobalt and nickel, is formed on the surface of the alloy, and maintaining the solution within that temperature range until the corrosion resistant film is at least 300 nm thick.

9. A process according to claim 8 wherein the complexone comprises a disubstituted alkali metal salt of EDTA.

10. A process according to claim 8 wherein the solution also contains a reducing agent.

11. A process according to claim 10 wherein the reducing agent comprises hydrazine.

12. A process according to claim 9 wherein the solution is heated to within the temperature range 175° C. to 225° C., preferably 200° C. to 210° C.

13. A process according to claim 12 wherein the solution is subsequently heated to within the temperature range 210° C. to 250° C., preferably 225° C. to 250° C.

14. A process according to claim 8 wherein the complexone is selected from at least one of a ferrous salt of EDTA, a chromium salt of EDTA, a ferrous salt of a derivative of EDTA, and a chromium salt of a derivative of EDTA.

* * * * *